US005417547A

United States Patent [19]

Harada

[11] Patent Number: 5,417,547

[45] Date of Patent: May 23, 1995

[54] VANED DIFFUSER FOR CENTRIFUGAL AND MIXED FLOW PUMPS

[75] Inventor: Hideomi Harada, Kanagawa, Japan

[73] Assignee: Ebara Corporation, Tokyo, Japan

[21] Appl. No.: 170,761

[22] Filed: Dec. 21, 1993

[30] Foreign Application Priority Data

Dec. 25, 1992 [JP] Japan ..... 4-359400
Nov. 2, 1993 [JP] Japan ..... 5-298883

[51] Int. Cl.[6] ..... F04D 29/44
[52] U.S. Cl. ..... 415/208.4
[58] Field of Search ..... 415/181, 199.2, 199.3, 415/208.2, 208.3, 208.4, 211.2

[56] References Cited

U.S. PATENT DOCUMENTS 3,356,289 12/1967 Plotkowiak .
3,372,862 3/1968 Koenig .
3,588,270 6/1971 Boelcs .
4,824,325 4/1989 Bandukwalla .

FOREIGN PATENT DOCUMENTS 971224 1/1951 France .
2185222 12/1973 France .
573559 4/1933 Germany .
53-119411 10/1978 Japan .
0126079 7/1984 Japan ..... 415/208.4
58-93996 6/1993 Japan .
317623 11/1956 Switzerland .
0879047 11/1981 U.S.S.R. ..... 415/208.4

OTHER PUBLICATIONS

Senoo et al., "Low Solidity Tandem Cascade Diffuser for Centrifugal Blower", Proceedings (B) of the Japan Society of Mechanical Engineers, vol. 49, No. 439, Mar., 1983.

Harada et al., "Numerical and Experimental Studies of Single and Tandem Low-Solidity Cascade Diffusers in a Centrifugal Compressor", The American Society of Mechanical Engineers, 93-GT-108, Int'l Gas Turbine and Aeroengine Congress and Exposition, Cincinnati, Ohio, May 24-27, 1993.

*Primary Examiner*—Edward K. Look
*Assistant Examiner*—Christopher Verdier
*Attorney, Agent, or Firm*—Armstrong, Westerman, Hattori, McLeland & Naughton

[57] ABSTRACT

A vaned diffuser for centrifugal and mixed flow pumps which has vanes in two rows radially displaced from each other, wherein the vanes are arranged in an optimal positional relationship to each other to improve the diffuser performance with the total pressure loss coefficient and the static pressure recovery coefficient. The vaned diffuser includes vanes arranged in a fluid flow field defined at the outer periphery of an impeller of a centrifugal or mixed flow pump. The vanes are circumferentially arranged in two rows, that is, a first row and a second row, which are equal in number of vanes and radially displaced from each other such that the respective chords of each pair of adjacent vanes in the first and second rows are approximately parallel to each other, and the trailing edges of the vanes in the first row and the leading edges of the vanes in the second row are radially spaced from each other at a distance $\Delta R = 0.05$ L to 0.4 L, where L is the chord length of the vanes in the first row.

2 Claims, 15 Drawing Sheets

E, G : VANED DIFFUSER OF PRESENT INVENTION
F, H : VANELESS DIFFUSER

VANED DIFFUSER FOR CENTRIFUGAL AND MIXED FLOW PUMPS

BACKGROUND OF THE INVENTION

Field of the Invention

The present invention relates to a vaned diffuser for centrifugal and mixed flow type liquid pumps, gas blowers, compressors and so forth. In this description and appended claims, such devices are generically called "pumps".

Description of the Prior Art

In conventional pumps, a diffuser is provided downstream of an impeller to efficiently convert the kinetic energy of a fluid flowing out from the impeller into static pressure; in many cases, a vaneless parallel wall diffuser is employed in order to enlarge the pump operating range as much as possible. In such a case, since the radius increases from the inlet to the outlet of the diffuser, the passage area increases toward the diffuser outlet. Thus, the flow velocity can be reduced, and it is therefore possible to convert the kinetic energy of the fluid flowlng out from the impeller into static pressure.

However, since the flow of fluid in the vaneless diffuser is in the form of an approximately free vortex, the passage length of the fluid flowing from the inlet to the outlet of the diffuser lengthens, and the friction loss increases, resulting in a reduction in the overall pump efficiency. To overcome the disadvantage, as the conventional method, various kinds of vanes are attached to the diffuser to actively decelerate the flow. However, this type of vaned diffuser has the disadvantage of a narrow operating range.

There is known a diffuser capable of obtaining pressure recovery over a wide operating range, such as that described in "Low Solidity Tandem Cascade Diffuser for Centrifugal Blower", Proceedings (B) of the Japan Society of Mechanical Engineers, Vol. 49, No. 439 (March, 1983) (hereinafter referred to as "Literature 1"). This low solidity tandem cascade diffuser has, as shown in FIG. 3, a first row of vanes 101 having a high pressure recovery ratio in a small capacity range, and a second row of vanes 102 capable of attaining a high pressure recovery in a large capacity range.

Examples of conventional double-cascade diffusers include those described in the specifications and drawings of Japanese Patent Public Disclosure (KOKAI) No. 53-119411 (1978) (hereinafter referred to as "Literature 2") and U.S. Pat. No. 4,824,325 (hereinafter referred to as "Literature 3"). These double-cascade diffusers have, as shown in FIG. 4, a first row of vanes 103 and a second row of vanes 104, which are radially displaced and different in number from each other.

Further, U.S. Pat. No. 3,372,862 (hereinafter referred to as "Literature 4") discloses in the specification and drawings thereof a technique in which vanes is arranged in the form of a double cascade such that the angular relationship between the two rows of vanes are variable. That is, as shown in FIG. 5, the angle of the vanes 105 in the first row to the vanes 106 in the second row is made variable. The technique, in which the angle of the vanes in the first row to the vanes in the second row is made variable, is also described in the specification and drawings of U.S. Pat. No. 3,356,289 (hereinafter referred to as "Literature 5").

Japanese Patent Public Disclosure (KOKAI) No. 58-93996 (1983) (hereinafter referred to as "Literature 6") discloses a diffuser in which vanes are arranged in two rows which are radially displaced from each other. In this diffuser, a spacing is provided between the first row of vanes 107 and the second row of vanes 108, as shown in FIG. 6. However, no optimal value for the spacing is mentioned in the Literature 6.

The inventor of this application studied vaned diffusers having a tandem-cascade structure as described above, and as a result, has found that the positional relationship between the two rows of vanes is extremely important for the performance of the vaned diffusers. FIGS. 7(*a*) and 7(*b*) show the results of the studies conducted by the present inventor. In the figures, the axis of abscissas represents the difference in angle between each pair of adjacent vanes in the two rows. (The angle 0 shows that the two vanes are parallel to each other.) The axis of ordinates represents the total pressure loss coefficient in FIG. 7(*a*) in the whole diffuser, including the vanes, and also the static pressure recovery coefficient in FIG. 7(*b*) in the whole diffuser, including the vanes.

As will be clear from FIG. 7(*b*), when the difference in angle between the two vanes is negative, the static recovery coefficient Cp In the whole diffuser is low, and the loss (loss coefficient $\zeta$) is large. Conversely, when the vanes are attached at a positive difference in angle, the static recovery coefficient in the whole diffuser increases, but the loss (loss coefficient) also increases. In this regard, the Literature 1 merely mentions that the overlap of the two rows of vanes is set at about 9% of the vane pitch angle (2 $\pi$ divided by the number of vanes), but makes no mention of the positional relationship between the two rows of vanes.

The studies conducted by the present inventor of this application reveal that when there is a difference between the number of vanes 103 in the first row and the number of vanes 104 in the second row as in the vaned diffusers described in the Literatures 2 and 3, the effectiveness is halved.

In the diffusers of the Literatures 4 and 5, in which the vane angle is made variable, the vane position may be made optimal by chance by varying the vane angle. However, these conventional diffusers are not based on the idea that the positional relationship between each pair of adjacent vanes in the two rows is important. Thus, there is no precedent in which vanes are arranged in an optimal positional relationship to each other to improve the diffuser performance with the total pressure loss coefficient and the static pressure recovery coefficient always harmonized with each other in the whole diffuser, including the vanes.

In the vaned diffuser described in the Literature 6, two rows of vanes are radially displaced from each other. However, the Literature 6 merely mentions that a spacing is provided between the two rows of vanes, and the number of vanes in the second vanes is different from the number of vanes in the first row. It is impossible to obtain, from the Literature 6, a concept of the optimal value for the radial spacing between the two rows of vanes.

SUMMARY OF THE INVENTION

In view of the above-described circumstances, it is an object of the present invention to provide a vaned diffuser for centrifugal and mixed flow pumps which has vanes in two rows radially displaced from each other, wherein the vanes are arranged in an optimal positional relationship to each other to improve the diffuser performance with the total pressure loss coefficient and the static pressure recovery coefficient harmonized with each other in the whole diffuser, including the vanes. To solve the above-described problems, the present invention provides a vaned diffuser having vanes arranged in a fluid flow field defined at the outer periphery of an impeller of a centrifugal or mixed flow pump, wherein, as shown in FIGS. 1 and 2, diffuser vanes 1 and 2 are circumferentially arranged in two rows, that is, a first row and a second row, which are equal in number of vanes and radially displaced from each other such that the respective chords of each pair of adjacent vanes 1 and 2 in the first and second rows are approximately parallel at an error within ±7.5° to each other.

In addition, the present invention provides a vaned diffuser wherein the respective chords of each pair of adjacent vanes 1 and 2 in the first and second rows are approximately parallel at an error within 7.5° to each other, and the vanes 1 and 2 are arranged so that the trailing edges of the vanes 1 in the first row and the leading edges of the vane 2 in the second row are radially spaced from each other at a distance $\Delta R=0.05$ L to 0.4 L, where L is the chord length of the vanes 1 in the first row.

In addition, the present invention provides a vaned diffuser wherein the vanes 1 and 2 are arranged so that the respective chords of each pair of adjacent vanes 1 and 2 in the first and second rows are approximately parallel at an error within ±7.5° to each other and that each vane 1 in the first row is spaced from an adjacent vane 2 in the second row in opposite direction of rotation of the impeller at a pitch $\Delta P=0$ to 0.4 L, where L is the chord length of the vanes 1 in the first row.

DESCRIPTION OF THE PREFERRED EMBODIMENTS OF THE INVENTION

Figure 7A:
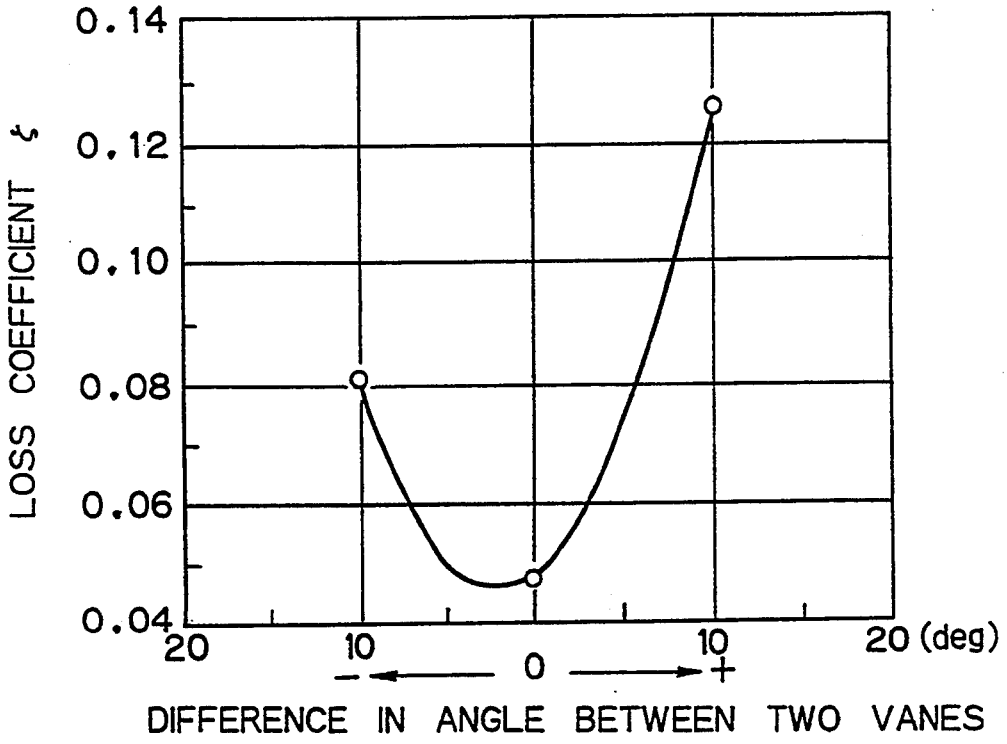
FIGS. 7(*a*) and 7(*b*) are graphs respectively showing the relationship of the total pressure loss coefficient ($\zeta$) and the static pressure recovery coefficient (Cp) to the difference in angle between two adjacent vanes in a tandem-cascade vaned diffuser.
Figure 7B:
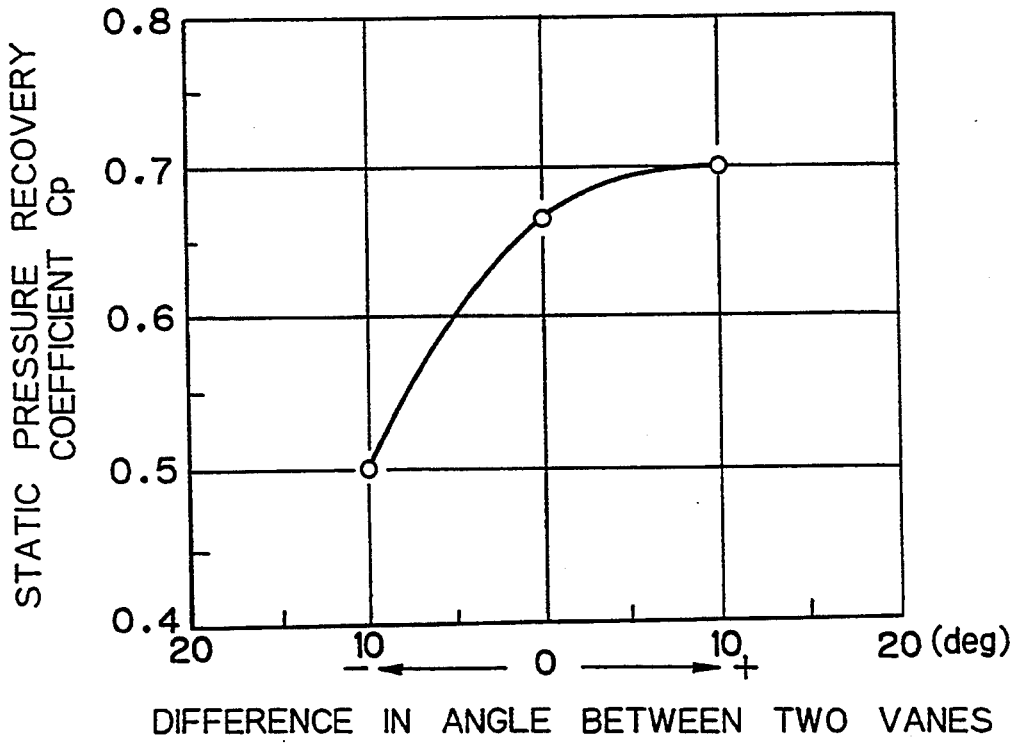

As will be clear from FIGS. 7(*a*) and 7(*b*), it has been revealed that when the difference in angle between the two vanes is negative, the static pressure recovery coefficient in the whole diffuser is low, and the loss is large, whereas, when the vanes are attached so that the difference in angle is positive, the static pressure recovery coefficient in the whole diffuser increases, but the loss also increases. Accordingly, to minimize the loss and increase the static pressure recovery coefficient to thereby utilize the diffuser characteristics to the full, the vanes should be arranged such that the respective chords of each pair of adjacent vanes in the two rows are approximately parallel at an error within ±7.5° to each other, as described above.

Figure 8:
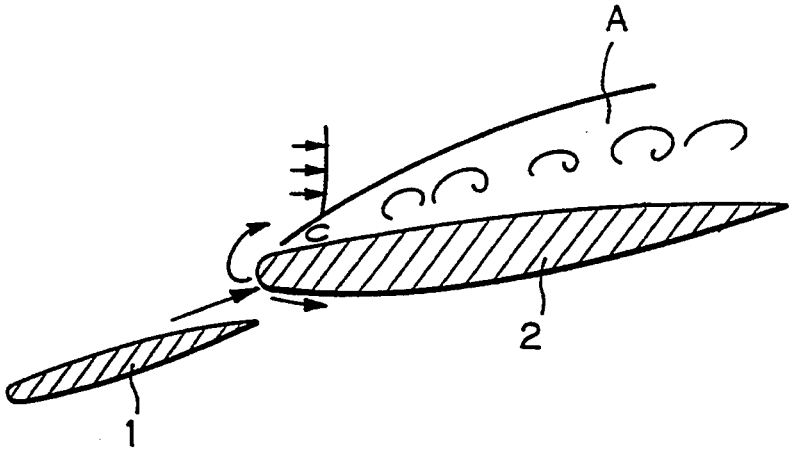
FIGS. 8(*a*) and 8(*b*) illustrate the operation of a pair of adjacent vanes in two rows of a vaned diffuser.
Figure 8:
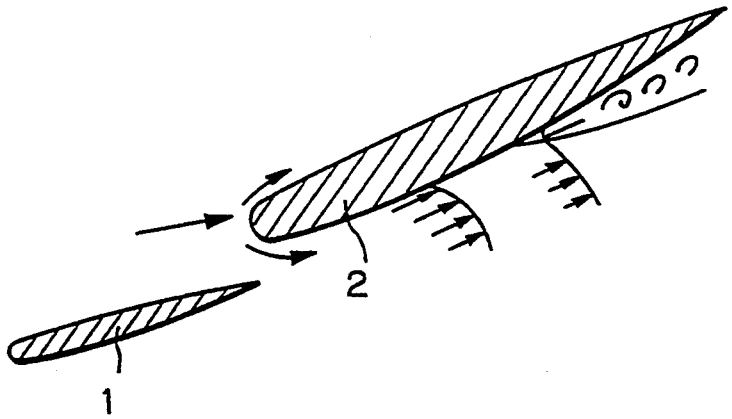

The principle of the present invention will be qualitatively explained below. As shown in FIG. 8(*a*), when the vane 2 in the second row is arranged at a negative angle to the vane 1 in the first row, the flow from the vane 1 in the first row collides against the suction surface of the vane 2 in the second row, and the flow that passes around the leading edge of the vane 2 to the pressure surface thereof is accelerated, as shown by the arrows. However, since the flow is decelerated in the rear of the pressure surface, the deceleration of the flow, which has been accelerated, is high. Consequently, the boundary layer A on the pressure surface of the vane 2 separates, causing a large loss.

Conversely, when the vane 2 in the second row is arranged at a positive angle to the vane 1 in the first row as shown in FIG. 8(*b*), the flow from the vane 1 in the first row collides against the pressure surface of the vane 2 in the second row, and the flow that passes around the leading edge of the vane 2 to the suction surface is accelerated, as shown by the arrows. In contrast to the installation of the vane 2 at a negative angle, the installation of the vane 2 at a positive angle provides a relatively large angle of incidence of the flow with respect to the vane 2. Therefore, the lift acting on the vane 2 increases until stall occurs on the surface of the vane 2. Accordingly, the pressure recovery ratio increases. However, as the angle of incidence increases, the loss also increases as a matter of course, resulting in as shown in FIG. 7(*a*).

It has become qualitatively clear from the above that the vanes 2 in the second row must be arranged at an optimal angle. Thus, it has been found from the studies conducted by the inventor of this application that the relative position of the vanes 1 and 2 in the first and second rows is the most important parameter for the diffuser performance, and that the most suitable arrangement for the vanes 1 and 2 in the first and second rows is realized by installing them such that the respective chords of the vanes 1 and 2 are approximately parallel at an error within ±7.5° to each other.

Figure 9:
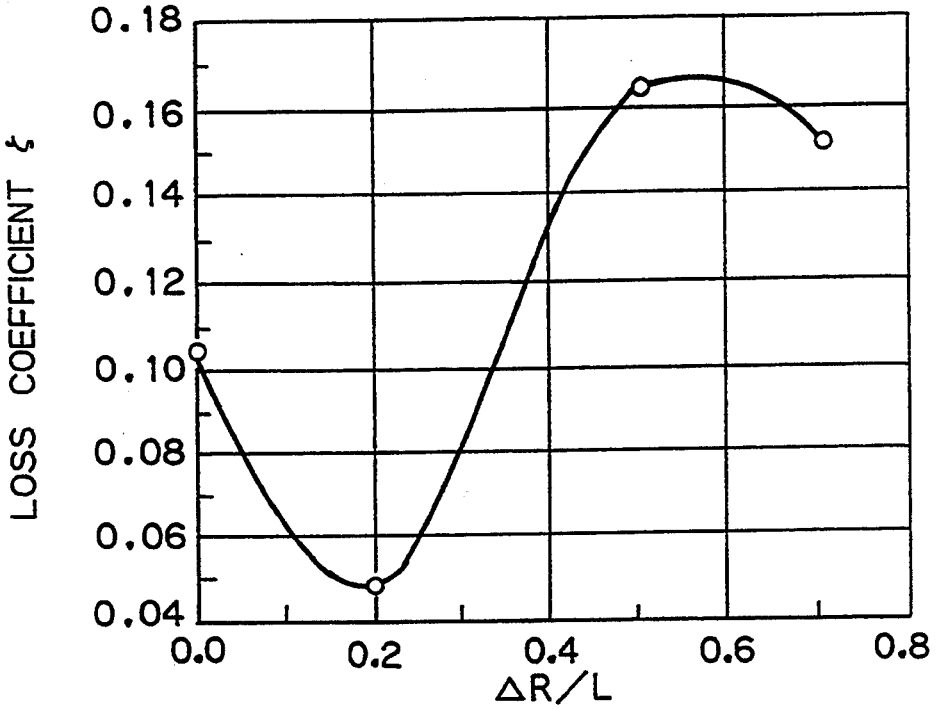
FIGS. 9(*a*) and 9(*b*) are graphs respectively showing change of the total pressure loss coefficient ($\zeta$) and the static pressure recovery coefficient (Cp) with the change in the radial spacing between a pair of adjacent vanes in two rows of a vaned diffuser.
Figure 9:
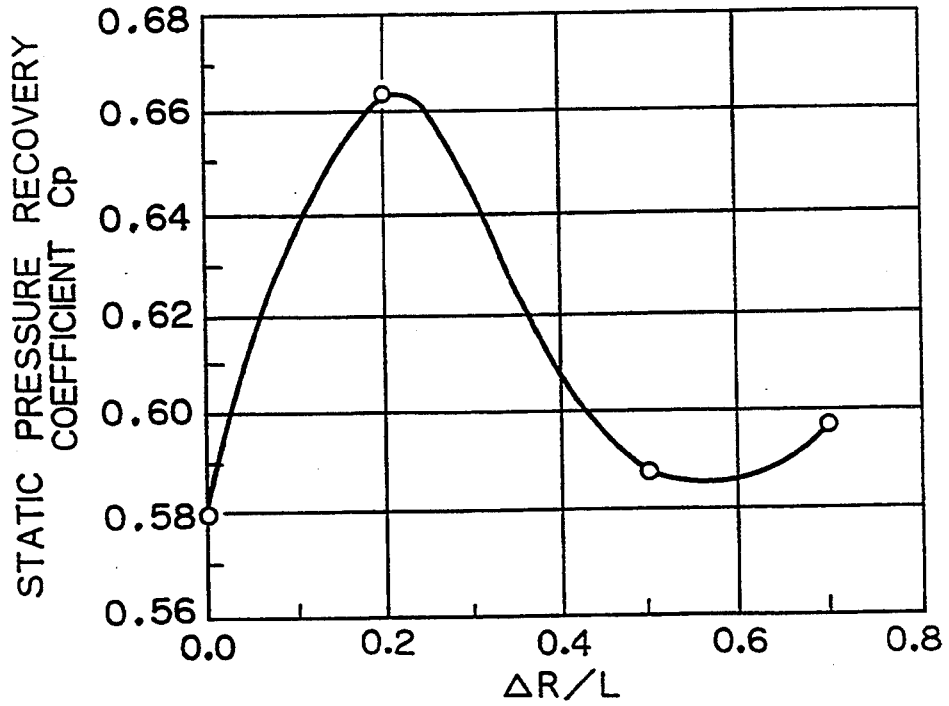

FIGS. 9(*a*) and 9(*b*) are graphs showing the results obtained by varying the radial positions of the two vanes 1 and 2. The axis of abscissas represents the radial distance ΔR between the two vanes 1 and 2 that is made into a nondimensional quantity (ΔR/L) by the chord length L of the vanes 1 in the first row. The axis of ordinates represents the total pressure loss coefficient (ζ) in FIG. 9(*a*)in the whole diffuser, including the vanes 1 and 2, and also the static pressure recovery coefficient (Cp) in FIG. 9(*b*) in the whole diffuser, including the vanes 1 and 2. FIGS. 9(*a*) and 9(*b*) reveal that as the radial positions of the two vanes 1 and 2 change, the diffuser performance changes to a considerable extent. It has been found that the best performance is obtained when the spacing between the trailing edges of the vanes 1 in the first row and the leading edges of the vanes 2 in the second row is approximately 20% (ΔR/L=0.2) of the chord length of the vanes 1 in the first row. Accordingly, the diffuser performance can be improved to the utmost limit by arranging the vanes so that the radial spacing between the trailing edges of the vanes in the first row and the leading edges of the vanes in the second row assumes a predetermined value. B The above-described feature of the present invention will be qualitatively explained below with reference to FIGS. 10(*a*) and 10(*b*). A boundary layer B developed on the surface of the vane 1 in the first row leaves the vane 1, causing wake B′ to occur. The wake B′ flows rearwardly while enlarging as the distance increases. If the two vanes 1 and 2 are arranged away from each other, the vane 2 in the second row is completely wrapped in the wake B′ . In general, wake flow is attended with a large loss. Therefore, the performance of the diffuser, which has the vanes 1 and 2 combined in this way, degrades.

Figure 10:
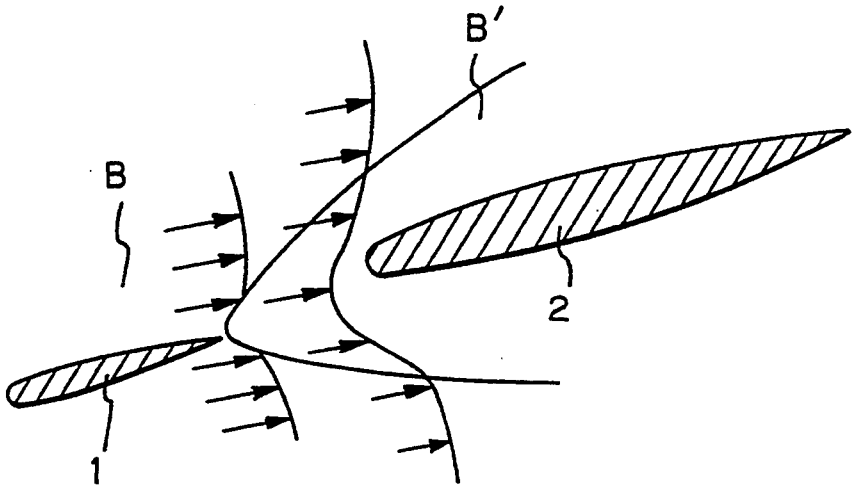
FIGS. 10(*a*) and 10(*b*) illustrate the operation of a pair of adjacent vanes in two rows of a vaned diffuser.
Figure 10:
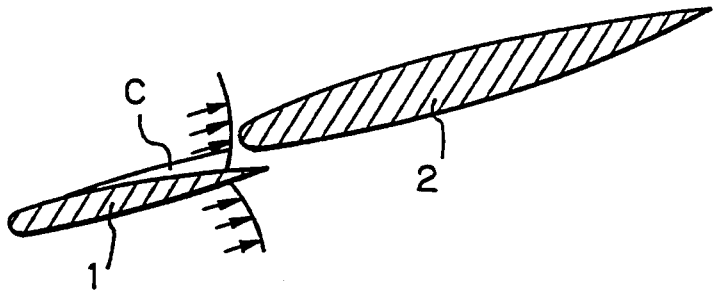

When the two vanes 1 and 2 are arranged excessively close to each other, as shown in FIG. 10(*b*), a boundary layer C developed on the pressure surface of the vane 1 in the first row flows directly to the vane 2 in the second row, resulting in an increase in the loss. Thus, it will be qualitatively understood that the performance of a diffuser having a combination of two vanes 1 and 2 is largely dependent on the radial positional relationship between the vanes 1 and 2 in the first and second rows.

Figure 11A:
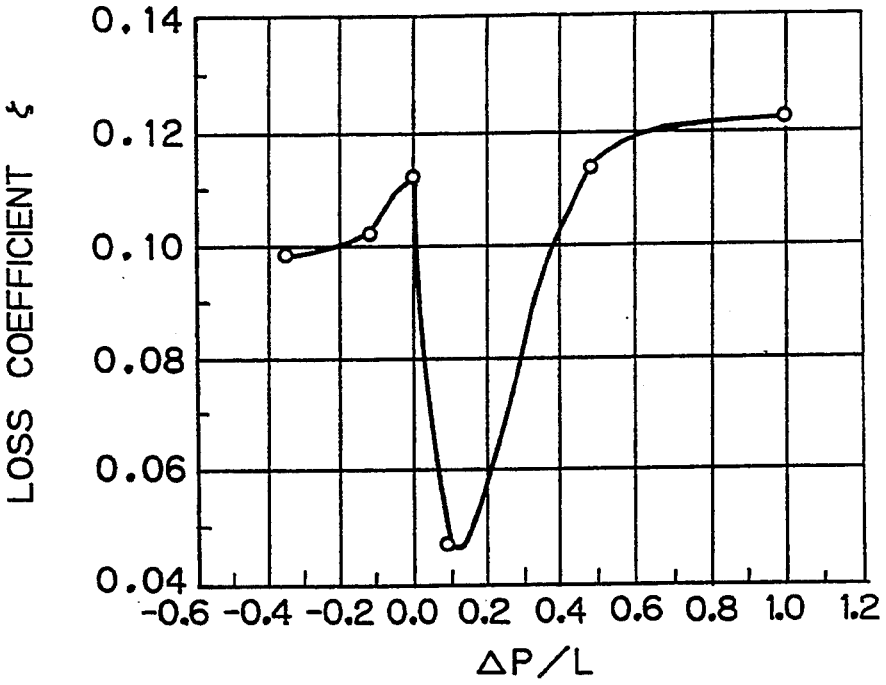
FIGS. 11(*a*) and 11(*b*) are graphs respectively showing changes of the total pressure loss coefficient ($\zeta$) and the static pressure recovery coefficient (Cp) with the difference in the circumferential spacing between a pair of adjacent vanes in two rows of a vaned diffuser.
Figure 11B:
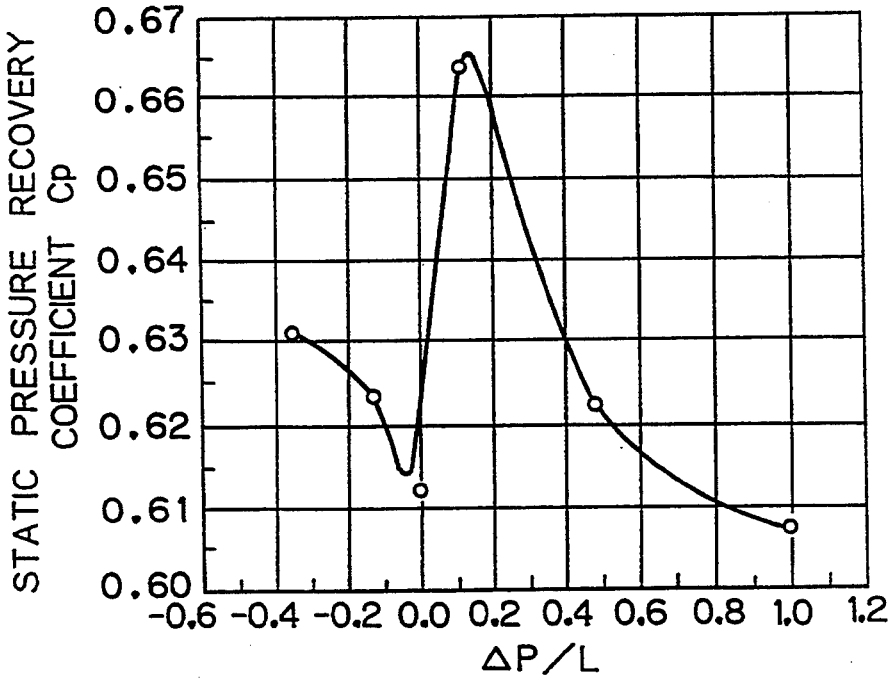

FIGS. 11(*a*) and 11(*b*) are graphs showing results obtained by varying the circumferential positions of the vanes 1 and 2 In the first and second rows in the direction of rotation of the impeller. In each figure, the axis of abscissas represents displacement pitch ΔP between the two vanes 1 and 2 that is made into a nondimensional quantity (ΔP/L) by the chord length L of the vane 1 in the first row. The axis of ordinates represents the total pressure loss coefficient (ζ) in FIG. 11(*a*) in the whole diffuser, including the vanes 1 and 2, and also the static pressure recovery coefficient (Cp) in FIG. 11(*b*) in the whole diffuser, including the vanes 1 and 2. FIGS. 11(*a*) and 11(*b*) reveal that as the circumferential positions of the two vanes 1 and 2 change in the direction of rotation of the impeller, the diffuser performance changes to a considerable extent. It has been found that the best performance is obtained when the vane 1 in the first row is displaced from the vane 2 In the second row in the opposite direction of rotation of the impeller (+direction in the figures) by the pitch Δ 0.1 L. Accordingly, a favorable result is obtained by displacing the vane 1 in the first row from the vane 2 in the second row in the opposite direction of rotation of the impeller by the pitch ΔP=0 to 0.4 L.

Figure 12:
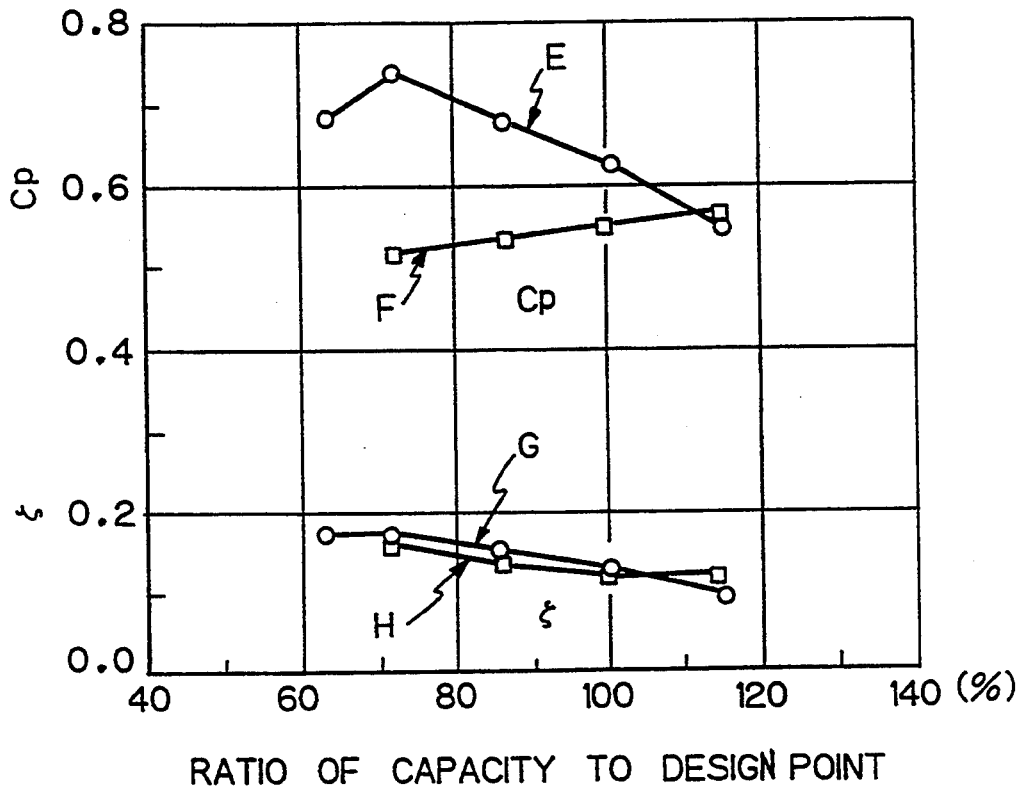
FIG. 12 is a graph showing the results of comparison between the vaned diffuser of the present invention and a vaneless diffuser.

FIG. 12 is a graph showing the results of comparison between the vaned diffuser of the present invention and a vaneless diffuser. In the figure, the axis of abscissas represents the ratio (%) of the capacity of a compressor provided with the diffuser to the design point. The axis of ordinates represents the static pressure recovery coefficient (Cp) and the total pressure loss coefficient (ζ) in order from the top. The curves E and G represent the vaned diffuser of the present invention. The curves F and H represent the vaneless diffuser. It will be understood from the figure that the vaned diffuser of the present invention provides excellent effects in comparison to the vaneless diffuser. The reason why the loss coefficient of the vaned diffuser of the present invention is approximately the same as the loss coefficient of the vaneless diffuser is that the loss generated as a result of the provision of the vanes is approximately the same as the loss reduced as a result of the lowering of the friction loss due to the shortening of the flow passage length.

Figure 1:
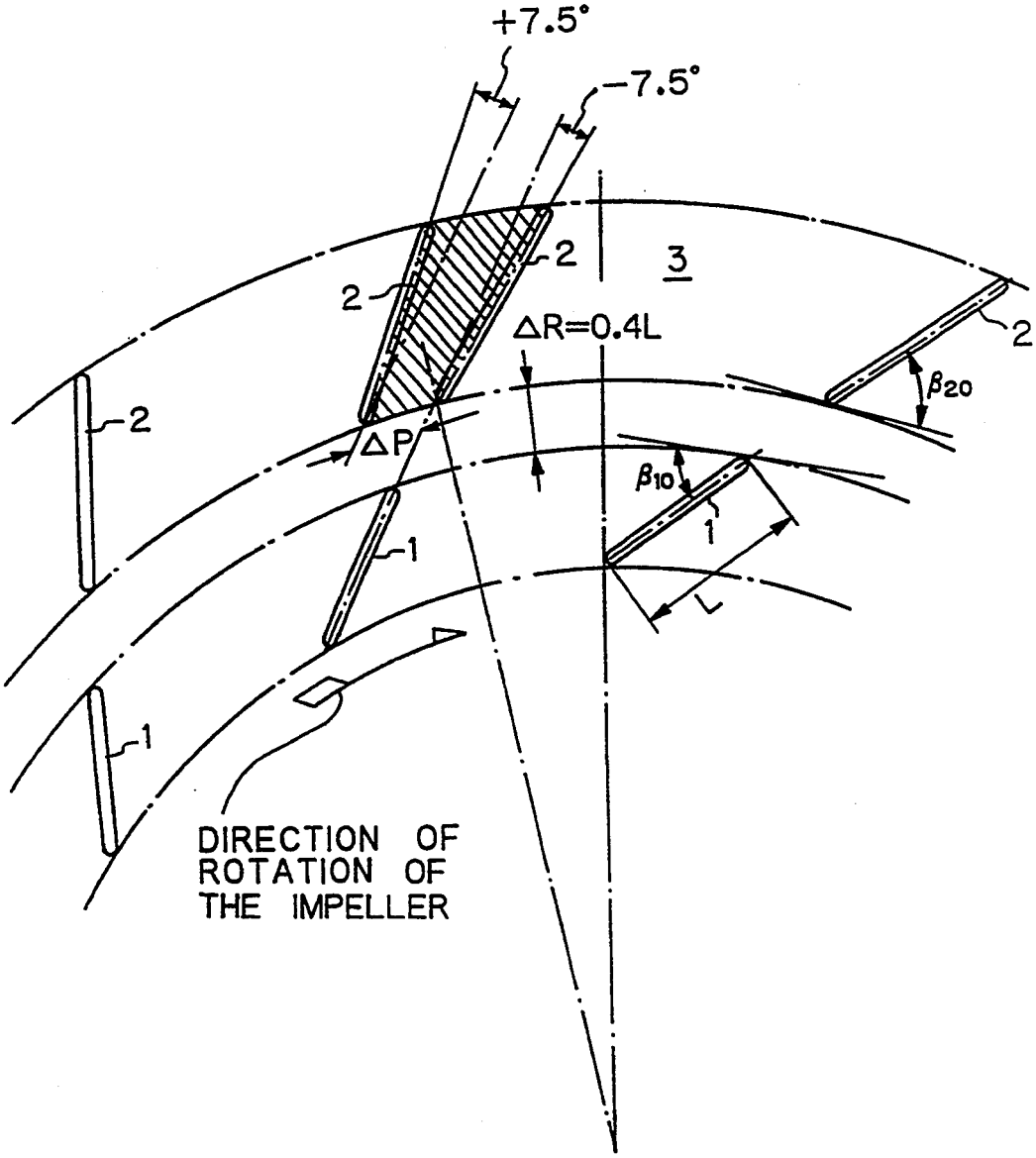
FIG. 1 schematically shows the arrangement of a vaned diffuser according to the present invention.
Figure 2:
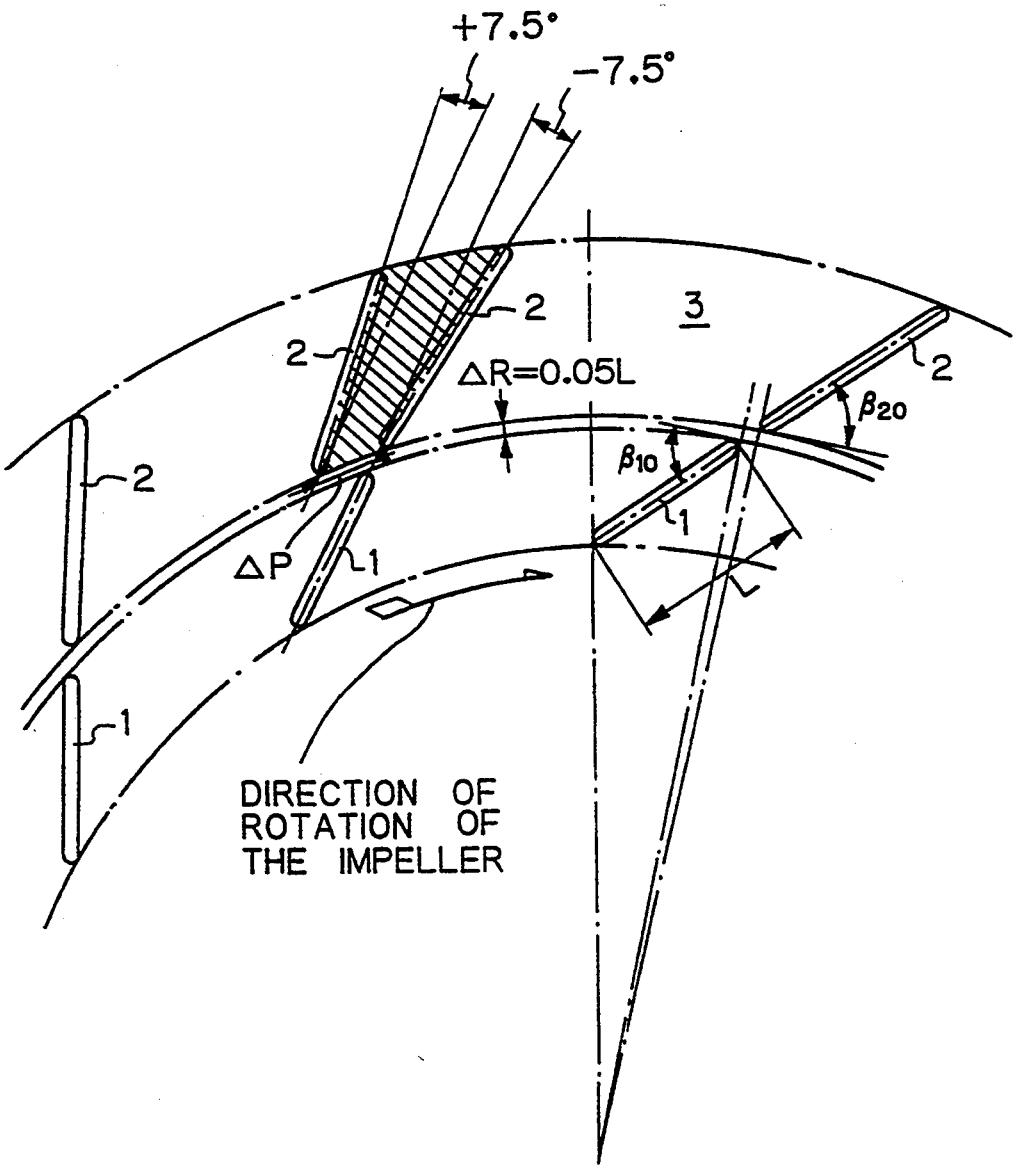
FIG. 2 schematically shows the arrangement of another vaned diffuser according to the present invention.
Figure 3:
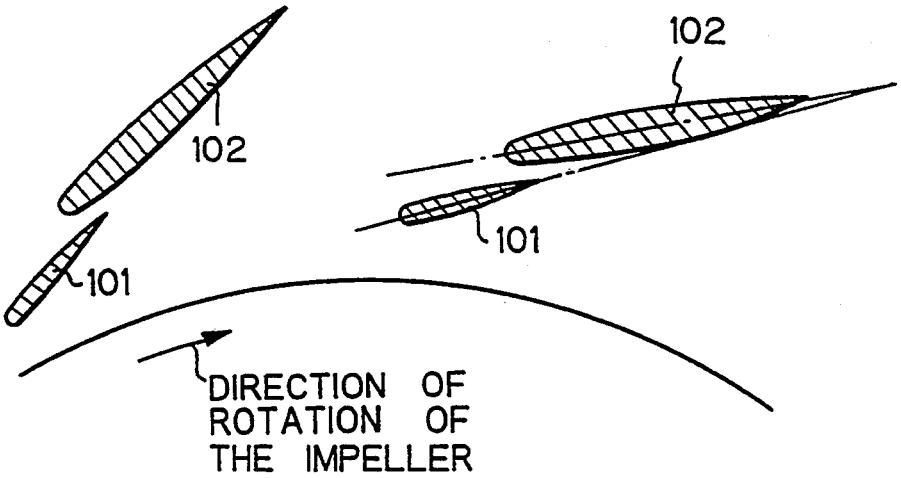
Fig. 3 PRIOR ART
FIG. 3 schematically shows the arrangement of a conventional vaned diffuser.
Figure 4:
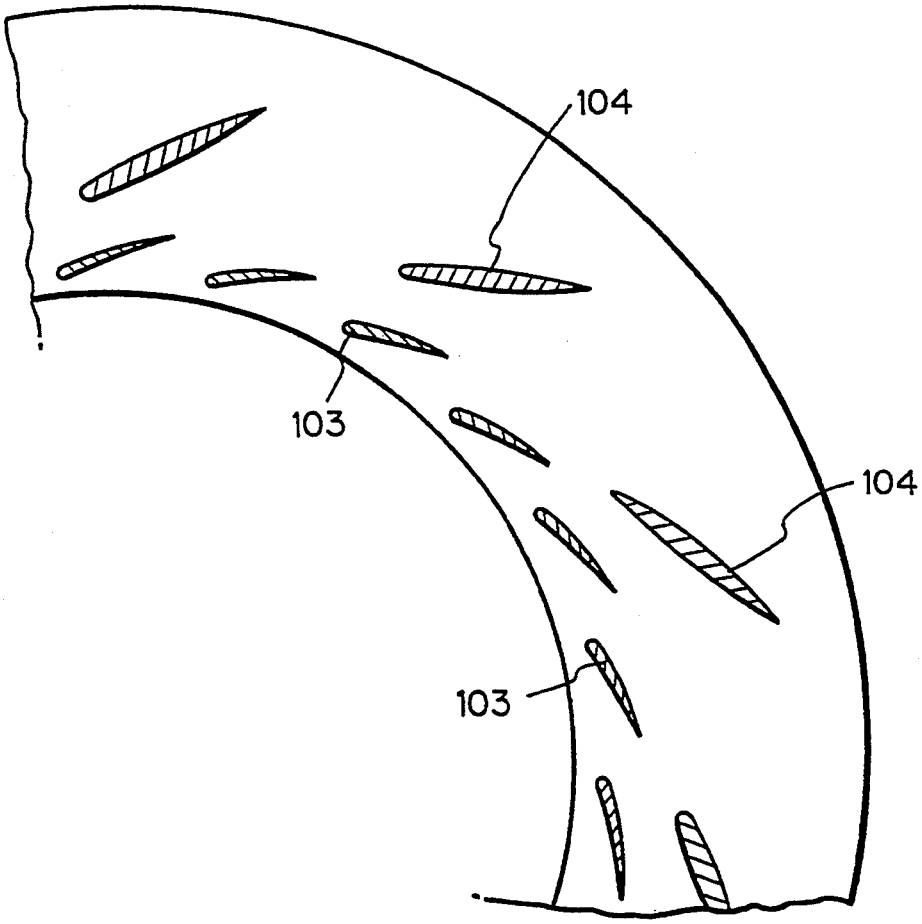
Fig. 4 PRIOR ART
FIG. 4 schematically shows the arrangement of another conventional vaned diffuser.
Figure 5:
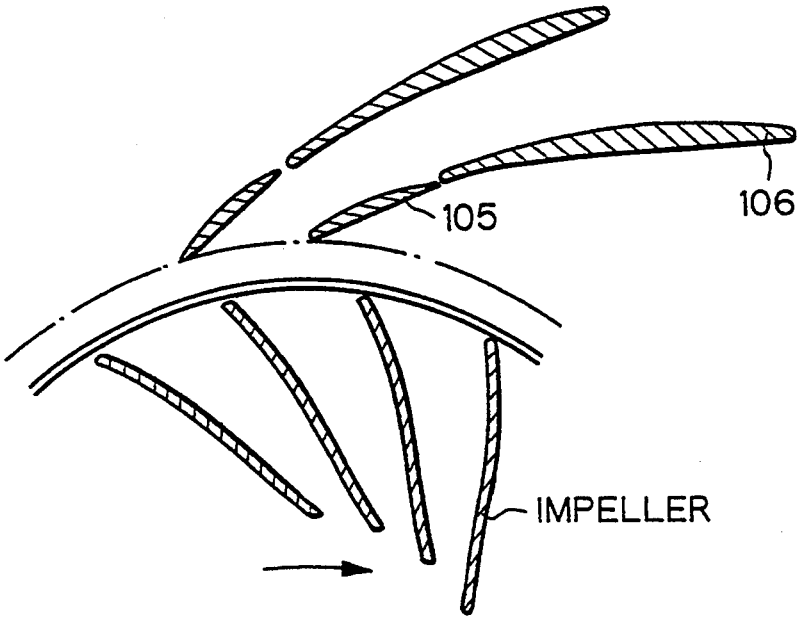
Fig. 5 PRIOR ART
FIG. 5 schematically shows the arrangement of still another conventional vaned diffuser.
Figure 6:
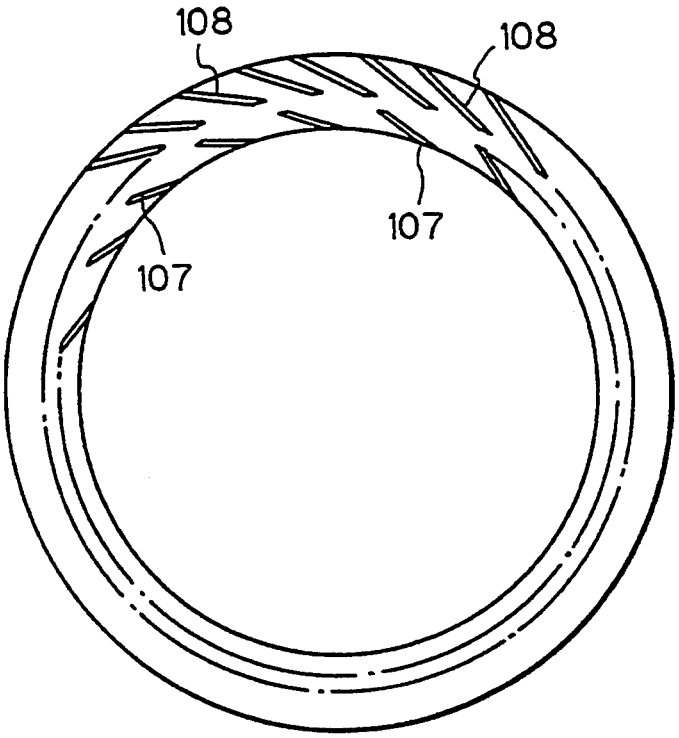
Fig. 6 PRIOR ART
FIG. 6 schematically shows the arrangement of a further conventional vaned diffuser.

Embodiments of the present invention will be described below with reference to the accompanying drawings. FIGS. 1 and 2 schematically show the arrangement of the vaned diffuser according to the present invention. As illustrated in the figures, the diffuser of the present invention has a first row of vanes I and a second row of vanes 2, which are arranged in a fluid flow field 3 defined at the outer periphery of an impeller of a pump. The number of vanes 1 in the first row and the number of vanes 2 in the second row are the same. The vanes 1 and 2 are arranged so that the respective chords of each pair of adjacent vanes 1 and 2 in the first and second rows are approximately parallel at an error within ±7.5° to each other, that is, $\beta_{20}-7.5° < \beta_{10}\eta_{20}+7.5$. The trailing edges of the vanes 1 in the first row and the leading edges of the vanes 2 in the second row are radially spaced from each other at a distance ΔR. In FIG. 1, ΔR=0.4 L, and in FIG. 2, ΔR=0.05 L, where L is the chord length of the vanes in the first row. In addition, each vane 1 in the first row is displaced from an adjacent vane 2 in the second row by a pitch ΔP in the opposite direction of rotation of the impeller. The pitch ΔP is set so as to be ΔP=0–0.4 L.

Figure 13:
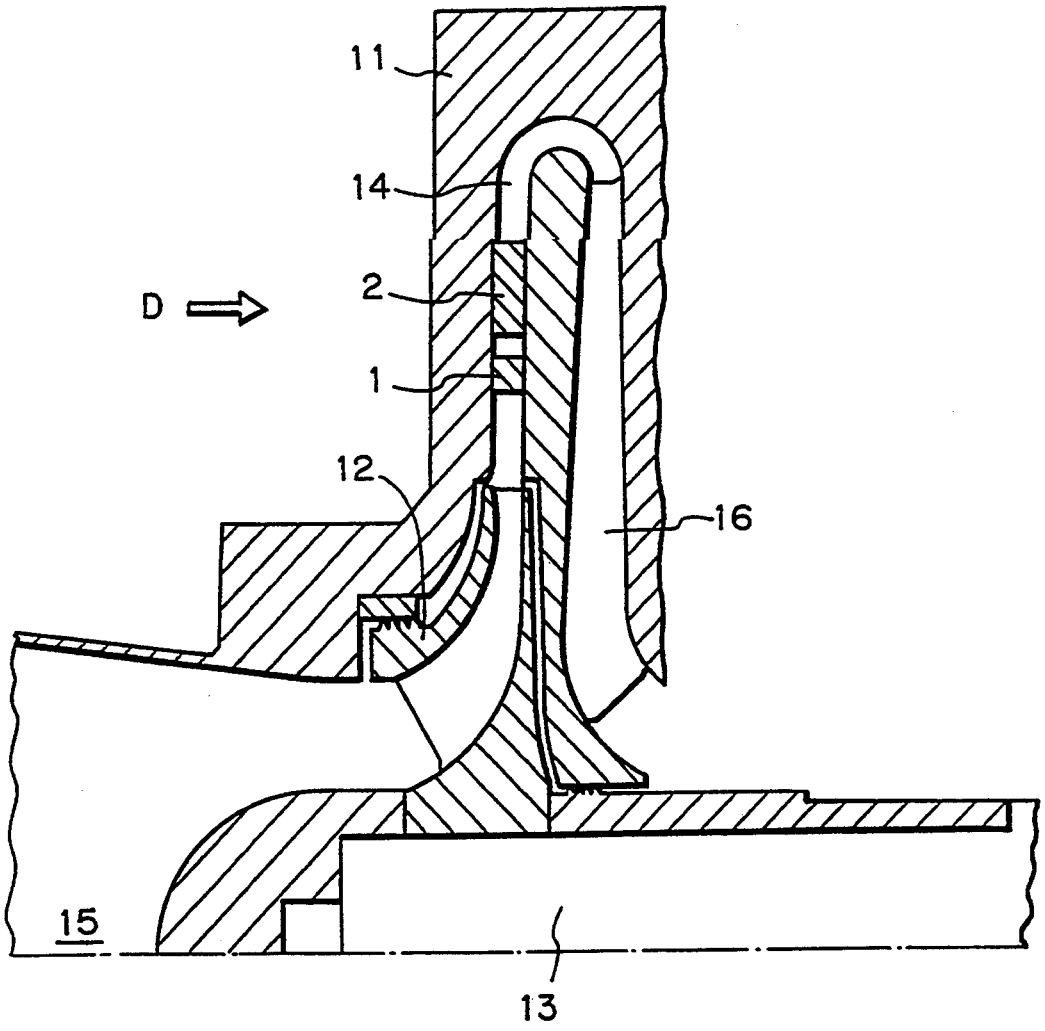
FIG. 13 shows the structure of a first-stage of a multi-stage centrifugal compressor that employs the vaned diffuser of the present invention.

FIG. 13 shows the structure of the first-stage of a multi-stage centrifugal compressor that employs the vaned diffuser of the present invention. As illustrated in the figure, an impeller 12 secured to a shaft 18 is rotatably arranged in a casing 11, and a first row of vanes 1 and a second row of vanes 2 are radially spaced in a fluid flow field 14 (diffuser section) defined at the outer periphery of the impeller 12. The number of vanes 1 in the first row and the number of vanes 2 in the second row are the same. The vanes 1 and 2 as viewed in the direction of the arrow D are in the same positional relationship as that in FIG. 1.

In the multi-stage centrifugal compressor having the above-described structure, as the impeller 12 rotates in response to the rotation of the shaft 18, a fluid is sucked in from a suction opening 15 and passed through the impeller 12. Then, the kinetic energy of the exit flow from the impeller is efficiently converted into static pressure by the action of the vanes 1 and 2 in the diffuser section 14. Then, the fluid flows to the subsequent stage (not shown) through a return channel passage 16.

Figure 14:
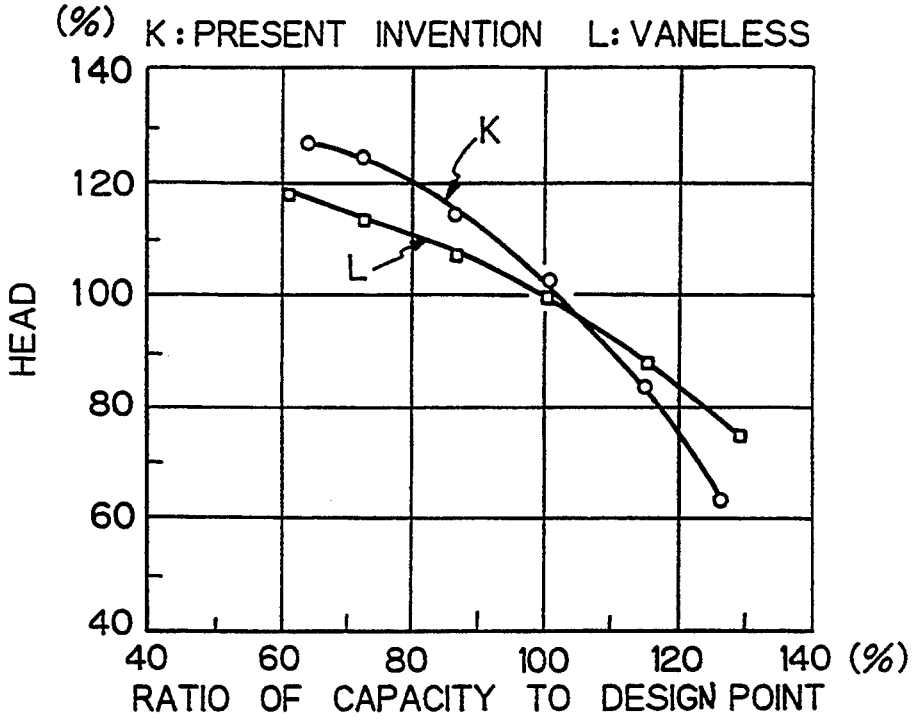
FIGS. 14(*a*) and 14(*b*) are graphs showing the results of testing of the multi-stage centrifugal compressor shown in FIG. 13, in which FIG. 14(*a*) shows the head of the compressor relative to the capacity, and FIG. 14(*b*) shows the compressor efficiency relative to the capacity.
Figure 14:
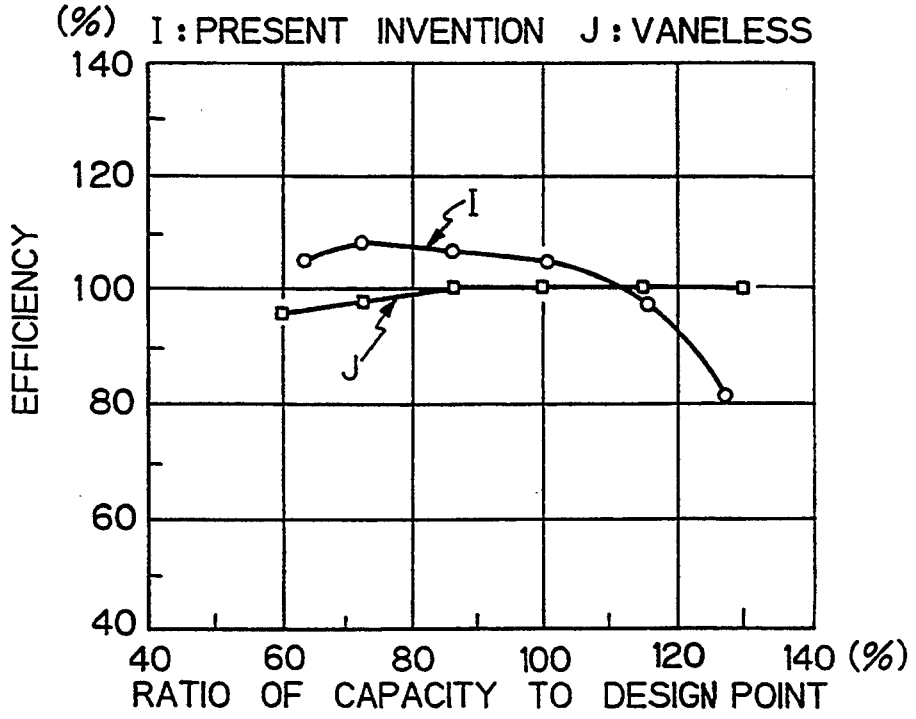

FIGS. 14(*a*) and 14(*b*) are graphs showing the results of testing of the multi-stage centrifugal compressor shown in the above-described embodiment. FIG. 14(*a*) shows the rise in head of the compressor relative to the capacity, and FIG. 14(*b*) shows the compressor efficiency relative to the capacity. The curves I and K represent the vaned diffuser of the present invention, and the curves J and L represent a conventional vaneless diffuser. It will be clear from FIG. 14 that the compressor provided with the vaned diffuser of the present invention is markedly improved in performance in comparison to the compressor provided with the conventional vaneless diffuser. That is, the overall efficiency can be improved by 4% at the design point capacity and by 10% in a low capacity range.

Figure 15:
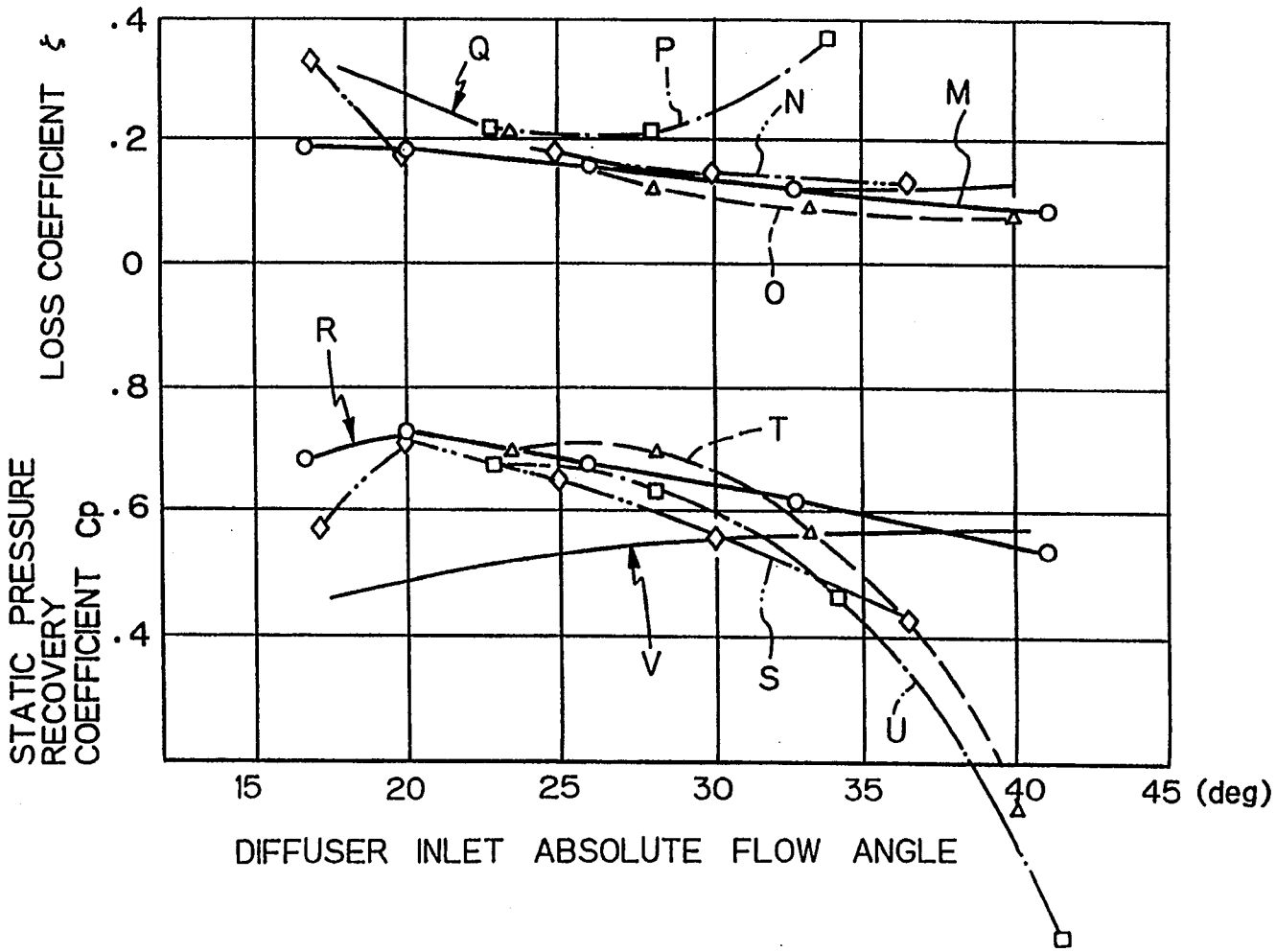
FIG. 15 is a graph showing the results of testing of the diffuser according to the present invention and various conventional diffusers for the total pressure loss coefficient ($\zeta$) and the static pressure recovery coefficient (Cp) relative to the diffuser absolute inlet flow angle (deg).
Figure 16:
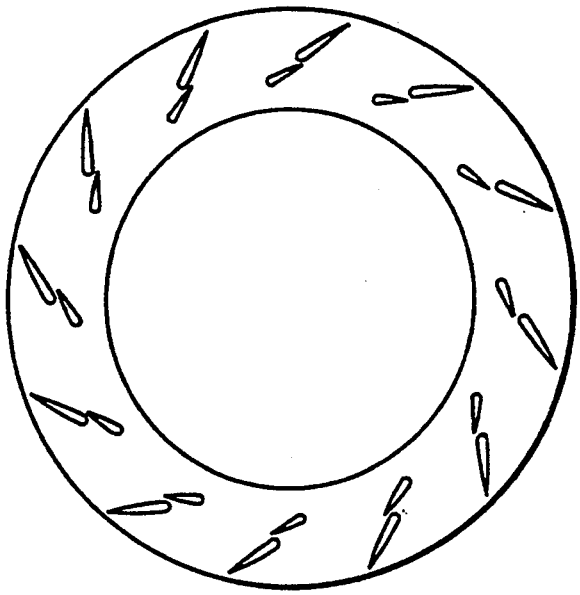
FIGS. 16(*a*) and 16(*b*) show the arrangements of various vaned diffusers.
Figure 16:
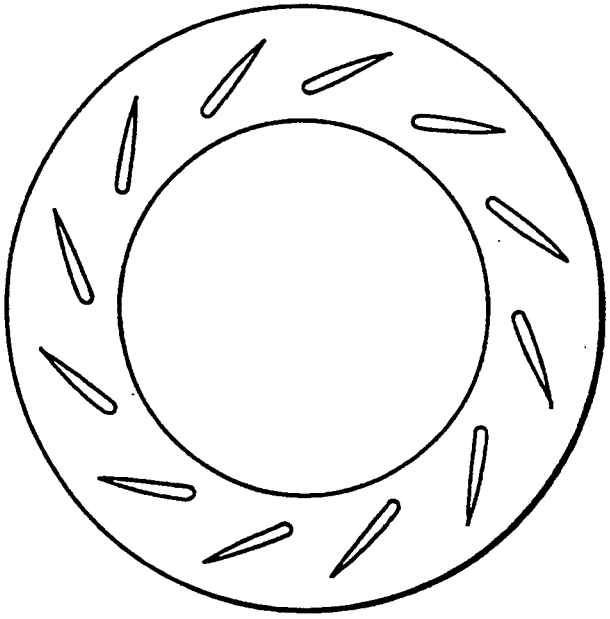
Figure 17:
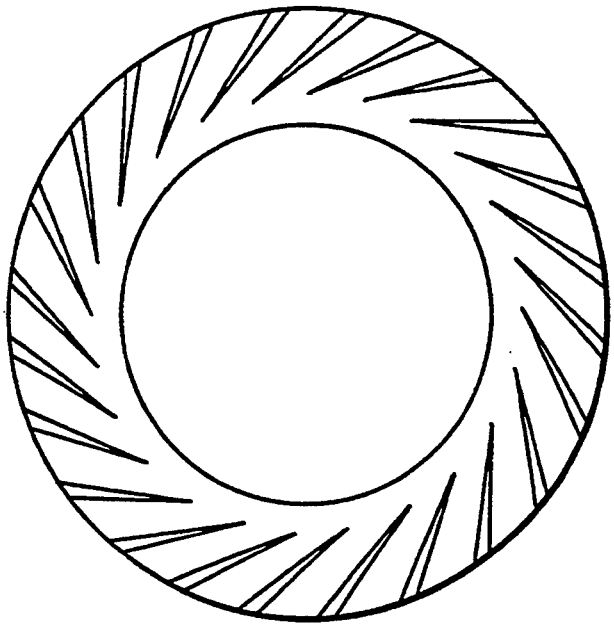
FIGS. 17(*a*) and 17(*b*) show also the arrangements of various vaned diffusers.
Figure 17:
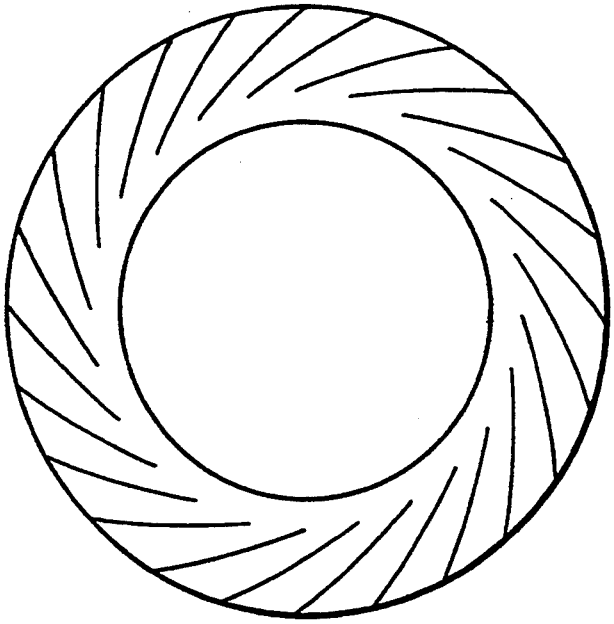

FIG. 15 is a graph showing the results of testing of the diffuser according to the present invention and various conventional diffusers for the total pressure loss coefficient ($\zeta$) and the static pressure recovery coefficient (Cp) relative to the diffuser inlet flow angle (deg). The curves M and R represent the vaned diffuser of the present invention as shown in FIG. 16(*a*). The curves N and S represent a single-row vaned diffuser as shown in FIG. 16(*b*). The curves O and T represent a wedge-shaped vaned diffuser as shown in FIG. 17(*a*). The curves P and U represent a circular vaned diffuser as shown in FIG. 17(*b*). The curves Q and V represent a vaneless diffuser. It will be clear from FIG. 15 that the vaned diffuser of the present invention is superior in performance to the other vaned and vaneless diffusers.

As has been described above, the present invention provides the following advantageous effects:

(1) Diffuser vanes are circumferentially arranged in two rows, that is, a first row and a second row, which are equal in number of vanes and radially displaced from each other such that the respective chords of each pair of adjacent vanes in the first and second rows are parallel $\pm 7.5°$ to each other. Accordingly, it is possible to minimize the loss and increase the static pressure recovery ratio. Thus, the characteristics of the diffuser can be utilized to the full.

(2) In addition, the vanes are arranged so that the trailing edges of the vanes in the first row and the leading edges of the vanes in the second row are radially spaced from each other at a distance $\Delta R = 0.05$ L to 0.4 L (where L is the chord length of the vanes in the first row). Thus, the performance of the diffuser can be improved to the utmost limit.

(3) Further, the vanes are arranged so that each vane in the first row is spaced from an adjacent vane in the second row in opposite direction of rotation of the impeller at a pitch $\Delta P = 0$–0.4 L. Thus, the performance of the diffuser can be improved to the utmost limit.

What is claimed is:

1. A vaned diffuser having vanes arranged in a fluid flow field defined at the outer periphery of an impeller of a centrifugal or mixed flow pump, wherein said vanes are circumferentially arranged in two rows, that is, a first row and a second row, which are equal in number of vanes and radially displaced from each other such that a chord of each vane in said first row and a chord of an adjacent vane in said second row are approximately parallel at an error within $\pm 7.5°$ to each other, and trailing edges of the vanes in said first row and leading edges of the vanes in said second row are radially spaced from each other at a distance $\Delta R = 0.05$ L to 0.4 L, where L is a chord length of the vanes in said first row.

2. A vaned diffuser as recited in claim 2 wherein the chord of each vane in said first row is spaced from the chord of a succeeding vane in said second row in a direction of rotation opposite to a direction of rotation of said impeller at a pitch $\Delta P = 0$ to 0.4 L, where L is a chord length of the vanes in said first row.

* * * * *